United States Patent [19]

Ito

[11] Patent Number: 4,798,374

[45] Date of Patent: Jan. 17, 1989

[54] SWITCHABLE AUTOMATIC OR MANUAL MODE PAPER FEEDING DEVICE HAVING A BIDIRECTIONALLY OPERATED MOTOR FOR A PRINTER

[75] Inventor: Noritugu Ito, Chita, Japan

[73] Assignee: Brother Kogyo Kabushiki Kaisha, Nagoya, Japan

[21] Appl. No.: 925,977

[22] Filed: Nov. 3, 1986

[30] Foreign Application Priority Data

Nov. 8, 1985 [JP] Japan ..... 60-251647

[51] Int. Cl.[4] ..... B65H 1/14; B65H 5/26

[52] U.S. Cl. ..... 271/9; 271/114; 271/117; 271/126; 271/157; 271/162; 271/257; 271/272; 400/625; 400/629; 400/636.2

[58] Field of Search ..... 271/9, 10, 21, 22, 24, 271/114, 116, 117, 118, 122, 126, 127, 256, 257, 258, 272, 157, 162, 208; 400/605, 624, 625, 629, 636, 636.1, 636.2; 74/384

[56] References Cited

U.S. PATENT DOCUMENTS

| | | | |
|---|---|---|---|
| 3,920,238 | 11/1975 | Kitajima et al. | 271/114 X |
| 3,926,428 | 12/1975 | Heldenbrand et al. | 271/208 X |
| 4,204,668 | 5/1980 | Yanagawa | 271/9 |
| 4,248,415 | 2/1981 | Steinhilber | 271/9 |
| 4,416,559 | 11/1983 | Steinhilber | 400/629 |
| 4,564,187 | 1/1986 | Costa et al. | 271/9 |
| 4,577,849 | 3/1986 | Watanabe | 271/10 X |
| 4,582,314 | 4/1986 | Yamamoto et al. | 271/127 |
| 4,606,663 | 8/1986 | Christoph et al. | 400/636 X |
| 4,618,134 | 10/1986 | Kawaquchi et al. | 271/9 X |
| 4,638,987 | 1/1987 | Sakurai | 271/116 X |
| 4,645,192 | 2/1987 | Watanabe | 271/9 |
| 4,664,546 | 5/1987 | Rünzi | 271/9 X |
| 4,667,947 | 5/1987 | Costa et al. | 271/9 |

FOREIGN PATENT DOCUMENTS

| | | | |
|---|---|---|---|
| 55-135033 | 10/1980 | Japan . | |
| 0028137 | 3/1981 | Japan | 271/22 |
| 0028396 | 2/1983 | Japan | 400/624 |
| 58-6633 | 2/1983 | Japan . | |
| 0211479 | 12/1983 | Japan | 400/636.2 |
| 0185675 | 10/1984 | Japan | 400/629 |
| 0002534 | 1/1985 | Japan | 271/162 |

*Primary Examiner*—Joseph J. Rolla
*Assistant Examiner*—Edward S. Ammeen
*Attorney, Agent, or Firm*—Parkhurst, Oliff & Berridge

[57] ABSTRACT

A paper feeding device for feeding paper to a printer wherein the paper is advanced by a paper feed motor and a print head prints on the paper while the paper is supported by a platen. The feeding device includes a paper stacker for storing a stack of paper sheets, a feed roller which is disposed for contact with a top sheet of the paper stack for feeding the top sheet when the roller is rotated, a first paper path for directing the top sheet from the paper stacker to the printer, a second paper path for directing another sheet of paper to the printer without passing the feed roller, a transmission mechanism disposed between the feed roller and the paper feed motor for transmitting a rotary motion of the paper feed motor to the feed roller, and a cut-off mechanism disposed in the transmission mechanism which is manually operated to a cut-off position in which the feed roller is operatively disconnected from the paper feed motor.

20 Claims, 7 Drawing Sheets

SWITCHABLE AUTOMATIC OR MANUAL MODE PAPER FEEDING DEVICE HAVING A BIDIRECTIONALLY OPERATED MOTOR FOR A PRINTER

BACKGROUND OF THE INVENTION

1. Field of the Invention

The present invention relates to a device for feeding paper to a paper feeding mechanism of a printer which prints on the paper while the paper is supported by a platen.

2. Discussion of Related Art

In the art of printing on cut sheets, there is known a printer equipped with an automatic sheet feeder which has a paper stacker for storing a stack of cut sheets and which is adapted to automatically feed the cut sheets one after another from the paper stacker toward the platen of printer, when the platen is placed in an automatic feed mode. Generally, the printer equipped with such an automatic sheet feeder may be switched, upon manipulation of a suitable operator-controlled member, from the automatic feed mode to a manual feed mode wherein the printer is loaded with a cut sheet which has been manually inserted by the operator. The automatic sheet feeder is arranged such that the top of the stack of cut sheets is held in pressed contact with a feed roller of the sheet feeder, so that the top sheet is fed from the paper stacker. To prevent the cut sheets from being fed from the paper stacker in the manual feed mode, provisions are made for moving the stack of paper and the feed roller away from each other when the automatic feed mode is replaced by the manual feed mode. However, the feed roller is kept operatively connected to a drive source and uselessly driven by the drive source even in the manual feed mode. This means that an unnecessary load is applied to the drive source, resulting in a waste of energy and a shortening of the service life of the associated components.

SUMMARY OF THE INVENTION

It is accordingly a primary object of the present invention to provide a paper feeding device for a printer, which has an automatic sheet feeder including a paper stacker, and which permits automatic sheet feeding from the paper stacker, and manual sheet insertion with the feed roller of the feeding device disconnected from the drive source.

This object may be achieved according to the present invention with a paper feeding device comprising: a paper stacker for storing a stack of paper sheets; and a feed roller disposed for contact with a top of the stack of sheets, and rotated for feeding a top sheet of the stack from the paper stacker; first passage means for defining a first paper path for directing the top sheet fed by the feed roller to the paper feeding means; second passage means for defining a second paper path for directing another sheet of paper to the paper feeding means without the above-indicated another sheet passing the feed roller; a transmission mechanism disposed between the feed roller and the paper feed motor for transmitting a rotary motion of the paper feed motor to the feed roller; and a cut-off mechanism disposed in the transmission mechanism, and manually operated to a cut-off position in which transmission of the rotary motion of the feed motor to the feed roller is interrupted.

In a printer equipped with the paper feeding device of the present invention constructed as described above, the cut sheets are fed toward the platen one after another from the paper stacker by the feed roller operatively connected to the paper feeding motor by means of the transmission mechanism, while the printer is placed in an automatic feed mode. Upon switching of the feed mode from the automatic mode to the manual mode, the cut-off mechanism is manually operated to its cut-off position to disconnect the feed roller from the paper feed motor. Therefore, the cut sheet manually inserted along the second paper path can be advanced toward the platen by the paper feeding means of the printer driven by the paper feed motor, while the feed roller of the paper feeding device is operatively disconnected from the paper feed motor.

Thus, the instant paper feeding device permits easy changeover between an automatic feed mode for automatically feeding cut sheets from the paper stacker one after another toward the platen along the first paper path, and a manual feed mode wherein a cut sheet may be manually inserted along the second paper path. Further, the manipulation of the operator-controlled cut-off mechanism upon selection of the manual feed mode will automatically cause the transmission mechanism to be disconnected, so as to cut off power transmission from the paper feeding motor to the feed roller of the paper feeding device. Hence, the cut-off mechanism prevents an unnecessary load which would otherwise be applied to the paper feeding motor.

According to one advantageous feature of the invention, the transmission mechanism comprises a gear train including a first gear, a second gear and a third gear which are rotatable about a first axis, a second axis and a third axis, respectively, and the cut-off mechanism comprises an operator-controlled lever which is supported pivotally about the first axis. The lever supports the second gear for rotation about the second axis, and is pivotally movable between a connected position for operative connection of the second gear with the third gear, and a disconnected position for operative disconnection of the second gear from the third gear.

In one form of the above feature of the invention, the cut-off mechanism further comprises biasing means for biasing the lever toward the connected position, and lock means for locking the lever in the disconnected position against a biasing force of the biasing means. The lock means includes a protrusion extending from the lever parallel to the first axis, and a stationary member disposed adjacent to the lever. The stationary member has an arcuate elongate hole formed along a circular arc which is described by the protrusion when the lever is pivotally moved about the first axis. The protrusion engages the arcuate elongate hole with a slight clearance therebetween in a direction perpendicular to the circular arc. The stationary member includes a locking portion which gives the arcuate elongate hole a constricted portion near one of opposite ends thereof which corresponds to the second position of the lever. The constricted portion has an original size slightly smaller than the perpendicular protrusion in the direction. The locking portion is elastically deformed to expand the constricted portion, thereby permitting the protrusion to pass the constricted portion to the above-indicated one end of the arcuate elongate hole when the protrusion is forced against the locking portion. The locking portion is restored to an original position to cause the expanded constricted portion to recover its original size, thereby locking the protrusion at the above-indicated one end of the arcute elongate hole, after the protrusion has passed the expanded constricted portion of the elongate hole.

According to another advantageous feature of the invention, the paper feed motor is operable in opposite directions which consist of a foward direction for operating said paper feeding means in a paper feeding direction, and a reverse direction opposite to said forward direction. The feed roller is rotated through the transmission mechanism in a direction to feed the top sheet from the paper stacker when the feed motor is rotated in the reverse direction thereof. The paper feeding device further comprises detecting means for sensing the cut-of position of the cut-off mechanism; and motor control means connected to the feed motor and the detecting means. The motor controller means is adapted to operate the feed motor in the reverse direction by a predetermined angular amount, and to subsequently operate the feed motor in the forward direction, when the cut-off position of the cut-off mechanism is not detected by the detecting means. When the cut-off position of the cut-off mechanism is detected by the detecting means, the motor control means operates the feed motor in the forward direction without initially operating the feed motor in the reverse direction.

In one form of the above described feature of the invention, the transmission mechanism comprises a gear train including a first gear, a second gear and a third gear which are rotatable about a first axis, a second axis and a third axis, respectively, and the cut-off mechanism comprises an operator-controlled lever which is supported pivotally about the first axis. The lever supports the second gear for rotation about the second axis, and is pivotally movable between a first position for operative connection of the second gear with the third gear, and a second position for operative disconnection of the second gear from the third gear. The detector means is operable to detect at least one of the first and second positions of the operator-controlled lever.

In another form of the above described feature of the invention, the paper feeding means further comprises a pair of paper advancing rollers disposed in contact with each other at outer circumferential surfaces thereof, and between the feed roller and the paper feeding means of the printer. The pair of paper advancing rollers are connected to the feed motor such that the avancing rollers are rotated in a paper advancing direction to advance the top sheet toward the paper feeding means when the feed motor is operated in the forward direction, and are rotated in a direction opposite to the paper advancing direction so as to prevent a leading edge of the top sheet fed by the feed roller from passing through the advancing rollers toward the paper feeding means and thereby causing a leading portion of the top sheet to be buckled between the pair of paper advancing rollers and the feed roller. The second paper path may be advantageously arranged so as to lead to the pair of paper advancing rollers. Preferably, the paper feeding means may further comprise an earth member which is made of an electrically conductive material and which is connected to the ground. In this case, the earth member is disposed such that the leading portion of a buckled top sheet contacts the earth member.

The earth member may consist of a generally planar partition wall member which constitutes part of the first and second passage means, and which separates the first and second paper paths from each other. The partition wall member is disposed so that not only the top sheet, but also the above-indicated another sheet fed along the second paper path, can contact the partition wall member.

According to another advantageous feature of the invention, the paper feeding device further comprises: converting means including a pinion operatively connected to the paper feed motor, and a rack member engaging the pinion for converting bidirectional rotating movements of the pinion into linear reciprocating movements; a pushing member disposed on one of opposite sides of the stack of sheets on the paper stacker, remote from the feed roller. The pushing member is moved by the linear reciprocating movements of the rack member, between an advanced position thereof for forcing the stack of sheets against the feed roller, and a retracted position thereof in which the stack of paper is spaced away from the feed roller; and a clutch disposed between the pinion and the paper feed motor, for disconecting the pinion from the paper feed motor and thereby stopping an advancing movement of the pushing member when a contact pressure applied by the pushing member between the stack of sheets and the feed roller exceeds a predetermined upper limit.

Another object of the invention is to provide a paper feeding device for a printer, which has an automatic sheet feeder, and which has means for smooth and reliable feeding of cut sheets from a paper stacker of the sheet feeder to paper feeding means incorporated in the printer.

The above object may be achieved according to another aspect of the present invention by a paper feeding device comprising: a paper stacker for storing a stack of paper sheets; a feed roller which is disposed for contact with a top of the stack of sheets and which is rotated for feeding a top sheet of the stack from the paper stacker; pushing means operable between an advanced position thereof for forcing the stack of sheets against the feed roller, and a retracted position thereof in which the stack of sheets is spaced away from the feed roller; a pair of paper advancing rollers disposed in contact with each other at outer circumferential surfaces thereof, and between the feed roller and the printer; a transmission mechanism for transmitting a rotary motion of a paper feed motor to the feed roller and the paper advancing rollers; and control means for operating the paper feed motor in one of opposite directions to rotate the feed roller in a paper feeding direction for feeding the top sheet from the paper stacker toward the pair of paper advancing rollers, and to rotate the paper advancing rollers in a direction that causes the paper advancing rollers to prevent a leading end of the top sheet from passing therebetween. The control means stops the paper feed motor when the leading end of the top sheet has abutted on the nip of the paper advancing rollers, and subsequently operates the paper feed motor in the other direction to rotate the paper advancing rollers in a paper advancing direction for feeding the top sheet toward the paper feeding means of the printer, by a predetermined distance.

According to one feature of the above described aspect of the invention, the pushing means is placed in the advanced position when the paper feed motor is operated in the above-indicated one of the opposite directions, and in the retracted position when the paper feed motor is operated in the other direction.

In one form of the above feature of the invention, the paper feeding device further comprises converting means including a pinion operatively connected to the paper feed motor, and a rack member engaging the pinion for converting bidirectional rotating movements of the pinion into linear reciprocating movements. The paper feeding device further comprises a clutch disposed betwen the pinion and the paper feed motor. The pushing means is disposed on one of opposite sides of the stack of sheets on the paper stacker, remote from the feed roller. The pushing means is moved by the linear reciprocating movements of the rack member, between the advanced and retracted positions. The clutch is adapted to disconnect the pinion from the paper feed motor and thereby stop an advancing movement of the pushing means when a contact pressure applied by the pushing means between the stack of sheets and the feed roller exceeds a predetermined upper limit.

A further object of the invention is the provision of a paper feeding device for a printer, which has an automatic sheet feeder, and which has means for maintaining a suitable contact pressure between the feed roller of the sheet feeder and a stack of cut sheets stored on the paper stacker of the sheet feeder, irrespective of a thickness of the paper stack.

This object may be achieved according to a still further aspect of the invention by a printer comprising: a paper stacker for storing a stack of paper sheets; a feed roller disposed opposite to a top of the stack of the sheets and operatively connected to paper feed motor for rotation thereof by the feed motor for feeding a top sheet of the stack from the paper stacker; converting means including a pinion operatively connected to the feed motor, and a rack member engaging the pinion for converting a rotating movement of the pinion into a movement; a pushing member disposed on one of opposite sides of the stack of sheets on the paper stacker, remote from the feed roller, the pushing member being advanced by the movement of the rack member for forcing the stack of sheets against the feed roller; and a clutch disposed between the pinion and the paper feed motor for disconnecting the pinion from the paper feed motor when a contact pressure applied by the pushing member between the stack of sheets and the feed roller exceeds a predetermined upper limit. The top sheet of the stack pressed in contact with the feed roller by the pushing member is fed by rotation of the feed roller toward the paper feeding means of the printer. An advancing movement of the pushing member toward the feed roller is stopped upon disconnection of the pinion from the feed motor by the clutch.

BRIEF DESCRIPTION OF THE DRAWINGS

The above and other objects, features and advantages of the present invention will become more apparent by reading the following detailed description of a preferred embodiment of the invention, when considered in connection with the accompanying drawings, in which.

DETAILED DESCRIPTION OF THE PREFERRED EMBODIMENT

Figure 1:
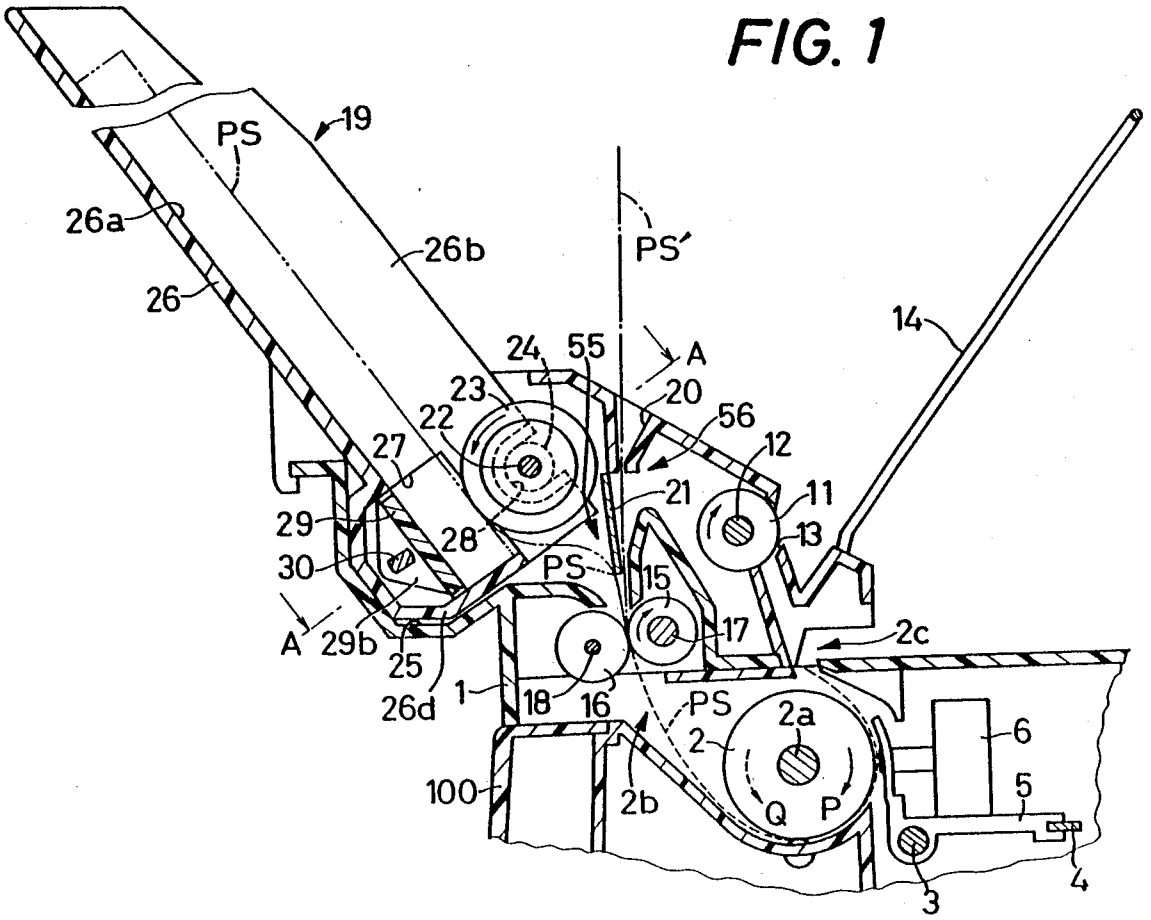
FIG. 1 is an elevational view partly in transverse cross section of a printer equipped with one embodiment of a paper feeding device of the present invention.
Figure 2:
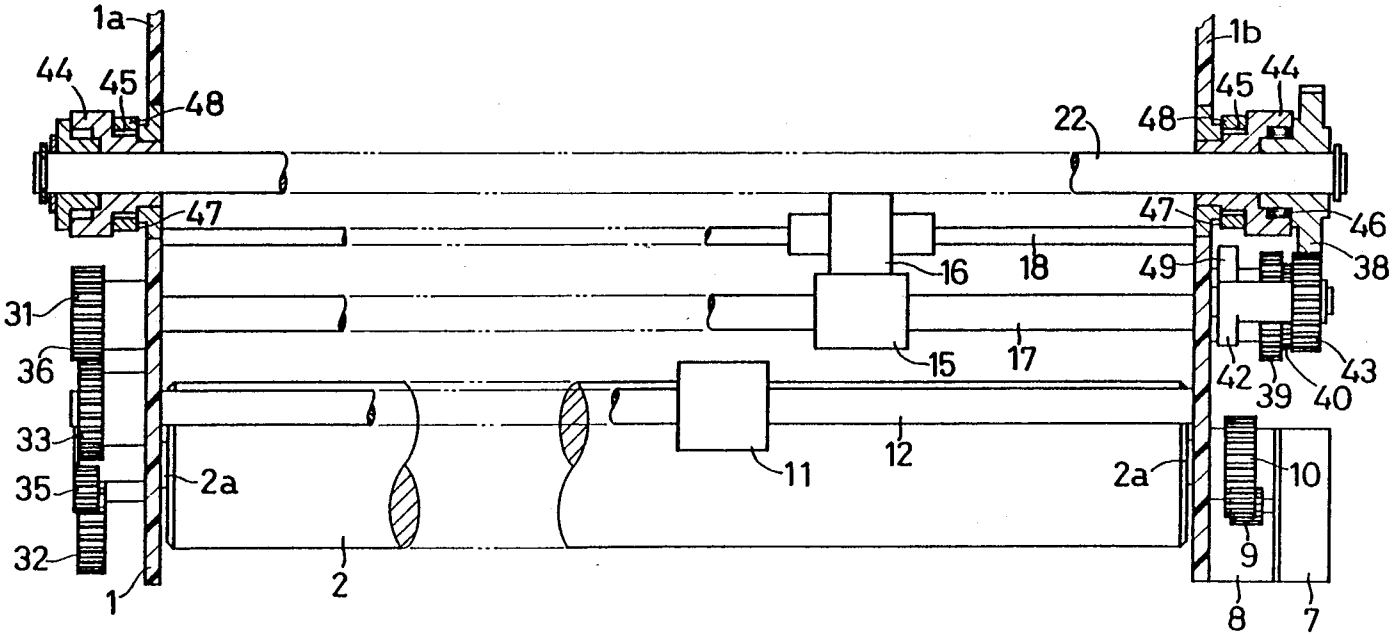
FIG. 2 is an elevational view partly in longitudinal cross section, primarily illustrating a transmission mechanism for various rollers.

Referring first to FIGS. 1 and 2, there is shown a printer equipped with a paper feeding device according to one embodiment of the invention, wherein a platen 2 is rotatably supported by a frame 100 of the printer, at its opposite small-diameter end portions 2a. As described later in detail, a cut sheet of paper PS or PS' is fed round the platen 2, so that the portion of the cut sheet PS or PS' at which printing occurs is supported by the platen 2. The frame 100 has rear portions defining a paper inlet 2*b* behind the platen 2, and front portions which support a guide rod 3 and a guide rail 4 such that the rod and rail 3, 4 xtend parallel to the platen 2. The cut sheet PS or PS' is fed through the paper inlet 2*b* toward the platen 2. A carriage 5 is slidably supported by the guide rod and rail 3, 4 so that the carriage 5 is reciprocable along the platen 2 in the right and left directions. The carriage 5 carries a print head 6 mounted thereon. Printing is effected on the cut sheet PS or PS' by the print head 6 while the carriage 5 is reciprocated along the platen 2.

On a motor bracket 8 attached to the right side of the printer frame 100, there is mounted a stepping motor 7 used as a paper feed motor. The motor 7 is connected to the platen 2 via a gear 9 fixed to the output shaft of the motor 7, and a gear 10 which is fixed to the right-hand side end portion 2a of the platen 2, in mesh with the gear 9. The paper feed stepping motor 7 is operated intermittently to rotate the platen 2 in the counter clockwise direction (in FIG. 1), or forward feeding direction, by means of the gears 9, 10, for advancing the cut sheet PS or PS' by a predetermined line-to-line distance each time a line of characters is printed on the cut sheet. Thus, the paper feed motor 7, platen 2 and gears 9, 10 constitute a major part of the paper feeding means of the printer.

As shown in FIG. 1, the paper feeding device is removably mounted on the printer frame 100, such that the device is located substantially above the platen 2. A roller shaft 12 extends between, and is rotatably supported by, right and left side plates 1a, 1b of a frame 1 of the paper feeding device. The roller shaft 12, which has a plurality of paper ejection rollers 11, is positioned above a paper outlet 2*c* formed in the printer frame 100. With the ejection rollers 11 rotated by the roller shaft 12 in the counterclockwise direction as seen in FIG. 1, the cut sheet PS or PS' printed while supported by the platen 2 is ejected through a paper exit 13 formed in the frame 1. Adjacent to the paper exit 13, there is provided a paper support 14 formed from a metal wire. The printed cut sheets PS, PS' ejected through the paper exit 13 are stacked on the paper support 14.

Two parallel roller shafts 17, 18 extend between, and are rotatably supported by, the right and left side plates 1*a*, 1*b*, such that the shafts 17, 18 are located above the paper inlet 2*b*. These roller shafts 17, 18 have a plurality of paper advancing rollers 15, 16, respectively. These advancing rollers 15, 16 are held in contact with each other at their outer circumferential surfaces. As described later, the roller shaft 17 is positively driven, while the roller shaft 18 is freely rotatable. With the advancing rollers 15 rotated by the roller shaft 17 in the counterclockwise direction as seen in FIG. 1, the cut sheet PS fed from a paper stacker 19 is advanced toward the platen 2. The paper stacker 19, which stores the cut sheets PS in a stack, is disposed such that it extends in a rear upward direction from a portion of the frame 1 adjacent to the advancing rollers 15, 16. As described in greater detail, the cut sheets PS stored in the paper stacker 19 are fed toward the nip of the advancing rollers 15, 16, one after another while the printer is placed in an automatic paper feed mode.

Right above the advancing rollers 15, 16, there is formed another paper inlet 20 in the frame 1, so that the cut sheet PS' can be manually inserted by the operator toward the advancing rollers 15, 16 while the printer is placed in a manual paper feed mode. Within the frame 1, there is formed a paper guide plate 21 which extends between the paper inlet 20 and the advancing rollers 15, 16, passing near the lower end of the paper stacker 19. This guide plate 21 is made of an electrically conductive material and connected to the ground. The guide plate 21 is arranged so that the cut sheet PS fed from the paper stacker 19 or the cut sheet PS' manually inserted through the paper inlet 20 will contact the guide plate 21 while the cut sheet PS or PS' is fed toward the nip of the advancing rollers 15, 16. This guide plate 21 not only serves as a partition wall partially defining a first paper path 55 and a second paper path 56, but also as an earth member for discharging or eliminating static electricity charged on the cut sheets PS, PS'. The first paper path 55 extends between the lower end of the paper stacker 19 and the nip of the advancing rollers 15, 16, while the second paper path extends between the paper inlet 20 and the nip of the advancing rollers 15, 16. The partition wall 21 whose lower end is positioned above the advancing rollers 15, 16, separates the first and second paper paths 55, 56 from each other. The first and second paper paths 55, 56 merge at the advancing rollers 15, 16, into a single common paper path leading to the platen 2.

Figure 3:
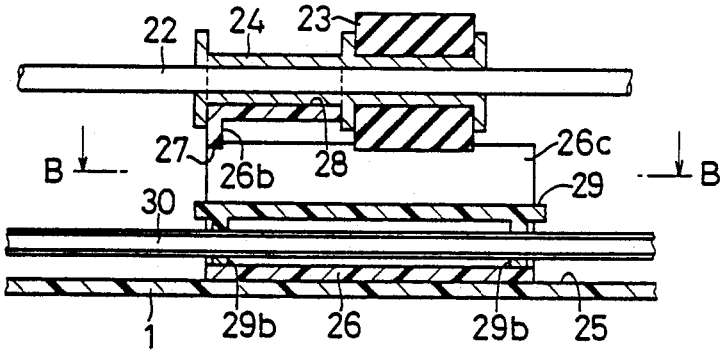
FIG. 3 is a view partly in cross section taken along line A—A of FIG. 1.

The paper stacker 19, and an arrangement for feeding the cut sheets PS from the stacker 19, will be described in detail. As shown in FIGS. 1–3, a roller shaft 22 is rotatably supported by the right and left side plates 1a, 1b of the frame 1 of the paper feeding device, such that the roller shaft 22 extends parallel to the advancing rollers 15, 16 and platen 2, across the width of the paper stacker 19. The roller shaft 22 has a pair of right and left feed rollers 23, 23 mounted thereon via respective sleeves 24, 24, so that the feed rollers 23, 23 are rotatable with the shaft 22, and are slidably movable on the shaft 22 for adjustment of an axial distance therebetween. The two feed rollers 23, 23 are positioned opposite to the bottom of the paper stacker 19 (which will be described), so that the feed rollers 23, 23 may be held in pressed contact with the top of the paper stack PS stored in the stacker 19 (with the top sheet PS of the stack).

Figure 4:
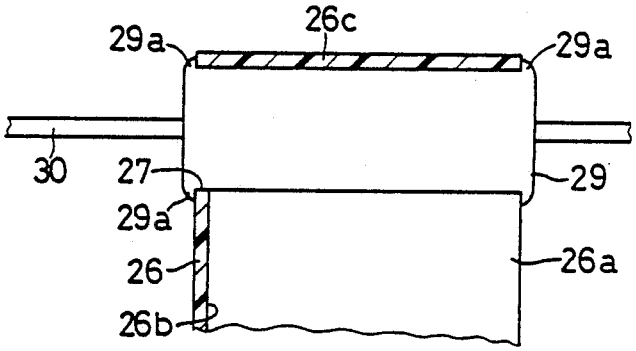
FIG. 4 is a view partly in cross section taken along line B—B of FIG. 1.

The rear portion of the frame 1 has a transverse recessed portion 25 which is disposed behind the lower portion of the paper stacker 19, so as to extend parallel to the roller shaft 22. Within this transverse recessed portion 25, there are slidably received lower portions 26d of a pair of right and left paper receiver members 26, 26 each having an L-shaped cross section. The two paper receiver members 26, 26, which constitute the paper stacker 19, correspond to the pair of feed rollers 23, and are movable relative to each other. Each receiver member 26 has a bottom wall 26*a* on which the paper stack PS is placed, and a side wall 26*b*. With the receiver members 26 suitably positioned relative to each other, a distance between the side walls 26*b* is adjusted depending upon the width of the cut sheets PS. As shown in FIGS. 1, 3 and 4, each side wall 26*b* has a rectangular aperture 27 and a U-shaped engagement portion 28. Each sleeve 24 for supporting each feed roller 23 on the roller shaft 22 is held in engagement with the corresponding U-shaped engagement portion 28, such that a pair of flanges formed on the sleeve 24 prevents a relative movement between the sleeve 24 and the corresponding receiver member 26 in the axial direction of the roller shaft 22. This arrangement permits the feed rollers 23 to be moved together with the paper receiver plates 26, for adjustment of the distance between the feed rollers 23 to suit the specific width of the cut sheets PS.

A pushing member 29 having a planar substantially rectangular shape is provided opposite to each feed roller 23, that is, on one side of the paper stack PS remote from the feed roller 23. The pushing member 29 has three lugs 29*a* at the corresponding three corners. These three lugs 29*a* engage the opposite edges of the corresponding rectangular aperture 27, and the edge of a lower wall portion 26c of the receiver member 26. Thus, the pushing member 29 is movable relative to the corresponding receiver plate 26 and feed roller 23. Each pushing member 29 has a pair of spaced-apart legs 29*b* on its rear surface remote from the feed roller 23. Between the right and left side plates 1*a*, 1*b* of the frame 1, an actuator rod 30 extends parallel to the roller shaft 22, so as to penetrate the legs 29*b* of the right and left pushing members 29. This actuator rod 30 is adapted to be movable toward and away from the feed rollers 23 between an advanced position in which the top of the paper stack PS on the stacker 19 is held in pressed contact with the feed rollers 23, and a retracted position in which the paper stack PS is spaced away from the feed rollers 23. In the advanced position of the actuator rod 30, the top sheet PS of the paper stack is fed by the feed rollers 23 rotating in the counterclockwise direction (in FIG. 1), from the paper stacker 19 toward the pair of advancing rollers 15, 16, along the first paper path 55.

Figure 5:
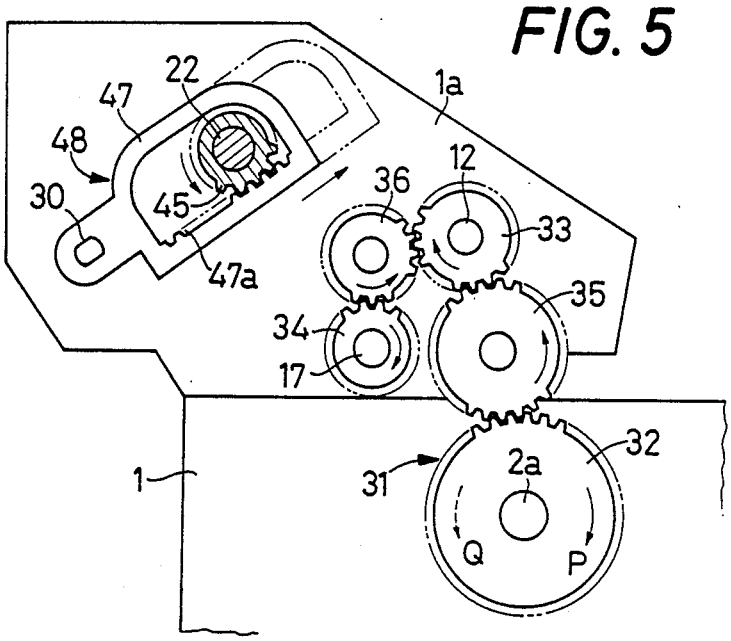
FIG. 5 is a fragmentary left-hand side end elevational view in cross section of the printer.
Figure 6:
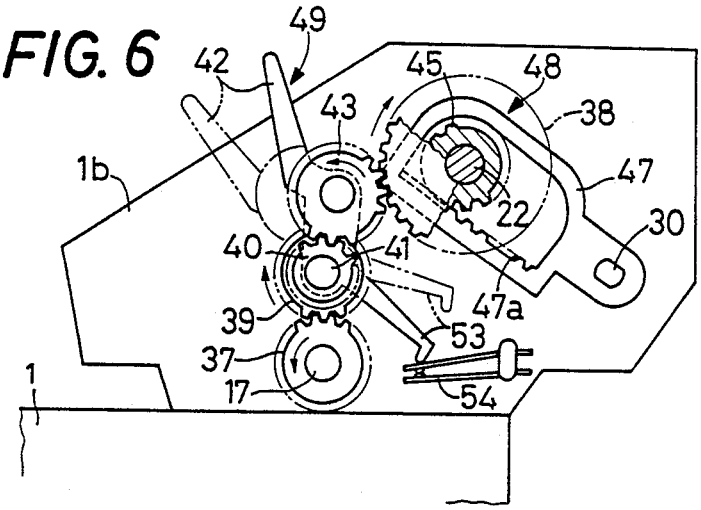
FIG. 6 is a fragmentary right-hand side end elevational view in cross section of the printer.

As indicated in FIGS. 2, 5 and 6, a power transmission mechanism 31 is provided between the paper feed motor 7 and the feed rollers 23, in order to transmit a rotary motion of the feed motor 7 to the feed rollers 23. Described in more detail, the small-diameter end portion 2a of the platen 2, the roller shaft 12 for the ejection rollers 11, and the roller shaft 17 for the advancing rollers 15, have gears 32, 33 and 34, respectively, fixed at their left ends. Intermediate gears 35 and 36 are freely rotatably supported on the left side plate 1*a*, such that the gear 35 meshes with the gears 32 and 33, while the gear 36 meshes with the gears 33 and 34. When the feed motor 7 is operated in a reverse direction to rotate the platen 2 in a direction P (opposite to a paper advancing direction Q) as indicated in FIGS. 1 and 5, the paper ejection rollers 11 and advancing rollers 15 are rotated in the clockwise direction (in FIG. 1) via the gears 32–36. When the feed motor 7 is operated in a forward direction to rotate the platen 2 in the paper advancing direction Q, the ejection and advancing rollers 11, 15 are rotated in the counterclockwise direction.

As shown in FIG. 6, the roller shaft 17 for the advancing rollers 15 has a gear 37 fixed to its right end, and the roller shaft 22 has a gear 38 freely rotatably mounted at its right end. Intermediate gears 39, 40 are freely rotatably supported on a shaft 41 fixed to the right side plate 1*b* of the frame 1. The intermediate gear 39 meshes with the gear 37. A changeover lever 42 is supported pivotally by the shaft 41. The changeover lever 42 supports an intermediate gear 43 in a freely rotatable manner, such that the gear 43 meshes with the gears 38 and 40.

Figure 7:
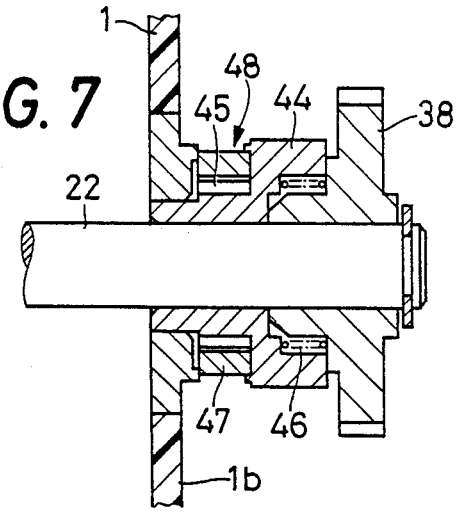
FIG. 7 is a fragmentary enlarged view partly in cross section, showing a spring clutch and the associated components shown in FIG. 2.

As shown in FIGS. 2 and 7, the roller shaft 22 has a pair of rotors 44 fixedly mounted on the opposite ends. Each rotor 44 has a pinion 45 integrally formed at its axially intermediately portion. A spring clutch 46 is disposed between the right-hand side rotor 44 and the gear 38, for transmitting a rotary motion of the gear 38 to the right-hand side rotor 44, to thereby rotate the roller shaft 22 and the feed rollers 23. As shown in FIGS. 2, 5 and 6, racks 47a of a pair of rack members 47 are held in engagement with the respective pinions 45 of the two rotors 44. The rack mmbers 47 are connected at their lower ends to the opposite ends of the actuator rod 30, so that the rack members 47 are moved by the actuator rod 30.

In the present embodiment, the pinions 45 and the rack members 47 constitute a converter mechanism generally indicated at 48, for converting bidirectional rotating movements of the pinions 45 into linear reciprocating movements of th track members 47. More specifically referring to FIGS. 1, 5 and 6, the rotation of the platen 2 in the direction P upon operation of the feed motor 7 in the reverse direction will cause the pinions 45 and feed rollers 23 to be rotated in the directions indicated by arrows in the figures, via the gears 32–40, 43, etc. With the rotating movements of the pinions 45, the rack members 47 are linearly moved in the upward direction, together with the actuator rod 30, whereby the pushing members 29 are moved toward the feed rollers 23 (to their advanced positions). On the other hand, when the platen 2 is rotated in the paper advancing direction Q with the feed motor 7 operated in the forward direction, the pinions 45 and the feed rollers 23 are rotated in the directions opposite to those indicated by arrows in FIGS. 1, 5 and 6, whereby the rack members 47 are linearly moved downward, to move the pushing members 29 to their retracted positions away from the feed rollers 23. When a contact pressure between the paper stack PS and the feed rollers 23 exceeds a predetermined upper limit, as a result of the advancing movements of the pushing members 29 to force the paper stack PS against the feed rollers 23, the operative connection by the spring clutch 46 between the gear 38 and the right-hand side rotor 44 is disconnected, whereby further advancing movements of the pushing members 19 toward the feed rollers 23 are prevented.

Figure 8:
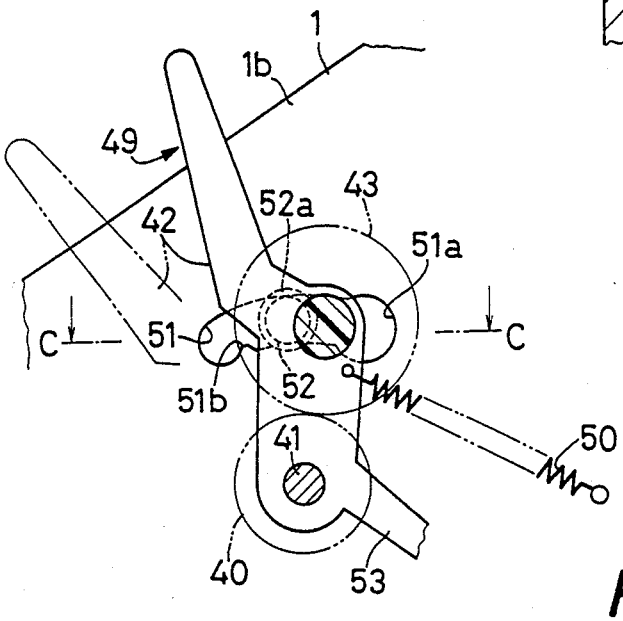
FIG. 8 is a fragmentary enlarged right-hand side end elevational view partly in cross section, showing a changeover lever of a cut-off mechanism.

In the present embodiment, the changeover lever 42 and the intermediate gear 43 on the lever 42 constitute a cut-off mechanism 49 which, when placed in its cut-off position, interrupts the operative connection between the feed rollers 23 (roller shaft 22) and the feed motor 7. As illustrated in FIG. 8, the changeover lever 42 is biased in the clockwise direction by a tension spring 50 which is fixed at its one end to the right side plate 1*a*, and at its other endi to the lever 49. That is, the tension spring 50 holds the changeover lever 42 in its first position (indicated in solid lines in FIGS. 6 and 8) in which the intermediate gear 43 on the lever 42 engages the gear 38 on the roller shaft 22. This first position of the changeover lever 42 is selected when the printer is operated in an automatic paper feed mode.

Figure 9:
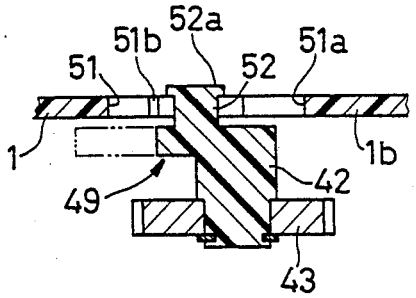
FIG. 9 is a partly cross sectional view taken along line C—C of FIG. 8.

The right side plate 1*b* of the frame 1 has a generally arcuate elongate hole 51 formed adjacent to the changeover lever 42, along a circular arc which is described by a protrusion in the form of a pin 52 formed on the inner surface of the pivotally supported changeover lever 42. The elongate hole 51 has an enlarged portion 51*a* at its one end corresponding to the first position of the changeover lever 42, and a constricted portion 51*b* near the other end corresponding to a second position of the changeover lever 42, as also shown in FIG. 9. The constricted portion 51*b* is partially defined by a locking tab which is formed on the side plate 1*b* so as to protrude inwardly of the hole 51. When the lever 42 is installed, its pin 52 is brought into engagement with the arcuate hole 51 after a large-diameter head 52*a* of the pin 52 is inserted through the enlarged portion 51*a*. The pin 52 has a diameter which is slightly smaller than a size of the arcuate elongate hole 51 as measured between the enlarged and constricted portions 51*a* and 51*b*, in the direction perpendicular to the arc of the hole 51, so that the pin 52 engages the elongate hole 51 with a slight clearance therebetween. In this arrangement, the changeover lever 42 is pivoted with its pin 52 guided in the arcuate elongate hole 51 between its first and second positions. When the changeover lever 42 is pivoted against the biasing action of the spring 50 toward its second position indicated in two-dot chain line in FIGS. 6 and 8, the intermediate gear 43 on the lever 42 is separated from the gear 38 on the roller shaft 22. In this connection, it is noted that the original size of constricted portion 51*b* is smaller than the diameter of the pin 52. However, while the pin 52 is moved to the end of the hole 51 corresponding to the second position of the lever 42, the pin 52 forces against the constricted portion 51*b*, or the locking tab 51*b* extending inwardly of the hole 51, whereby the locking tab 51*b* elastically yields, permitting the pin 52 to pass the expanded constricted portion toward the end of the hole 51. After the pin 52 has passed the expanded constricted portion 51*b*, the elastically deformed locking tab 51*b* is restored to its original position, causing the expanded constricted portion to recover its original size, thereby locking the pin 52 or the changeover lever 42 in its second position. Thus, the cut-off mechanism 49 is placed in its cut-off position. This cut-off position of the mechanism 49, i.e., the second position of the changeover lever 42, is selected when the printer is placed in the manual paper feed mode.

As indicated in FIG. 6, the changeover lever 42 has an operating arm 53 formed so as to extend from a portion adjacent to the shaft 41. On the right side plate 1b, there is disposed detecting means in the form of a mode detecting switch 54 positioned in alignment with the free end of the operating arm 53. This switch 54 is opened and closed by the operating arm 53, depending upon the currently selected position of the changeover lever 42. Namely, the detecting switch 54 generates a signal indicative of the currently selected position of the cut-off mechanism 49, or indicative of the currently selected one of the automatic and manual paper feed modes of the printer, and thus cooperates with the cut-off mechanism 49 to constitute selector means, in response to which a control system of the printer is operated as described below.

Figure 10:
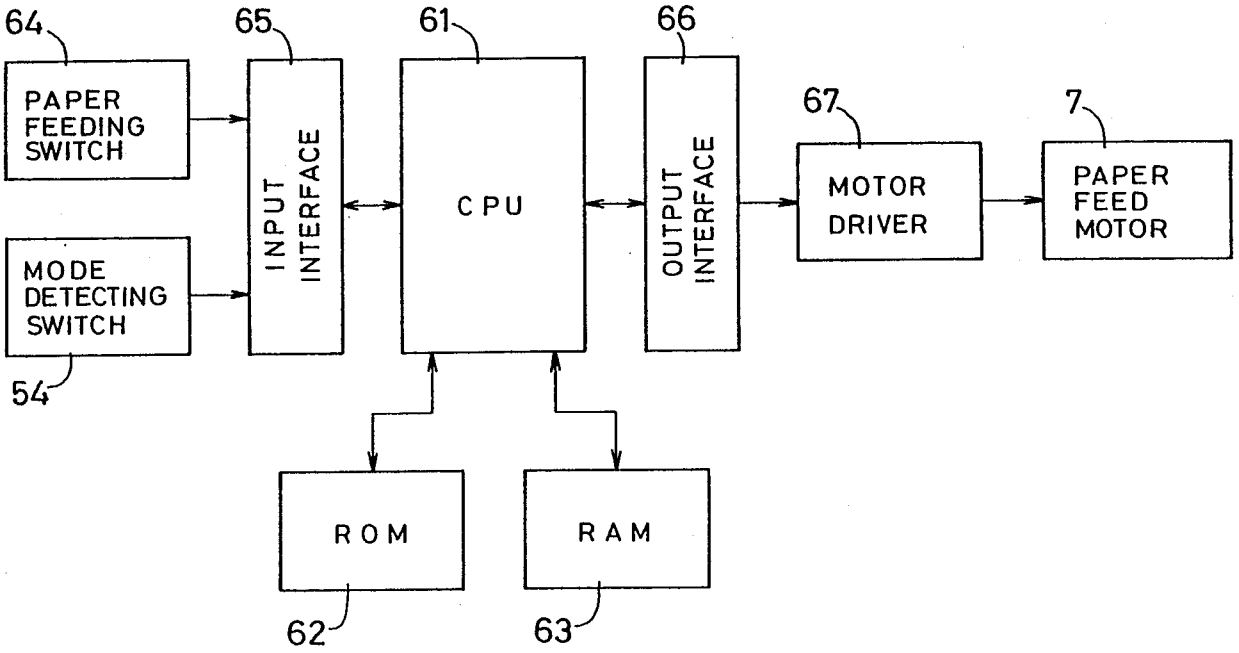
FIG. 10 is a block diagram showing a control system for controlling a paper feed motor.

Referring next to FIG. 10, a control system of the printer described above will be described, in connection with the paper feed motor 7 in particular. The control system includes a central processing unit (CPU) 61, and a read-only memory (ROM) 62 and a random-access memory (RAM) 63 which are connected to the CPU 61. The ROM 62 stores various control programs for controlling the operation of the printer, and the RAM 63 stores various data such as the number of stepping pulses to operate the paper feed motor 7 (stepping motor) in its reversed direction to feed the cut sheet PS from the paper stacker 19 along the first paper path 55 by a predetermined distance, and the number of stepping pulses to operate the motor 7 in its forward direction to advance the cut sheet PS from the paper stacker 19, or the manually inserted cut sheet PS' by a predetermined distance.

The CPU 61 is connected via an input interface 65 to the previously indicated detecting switch 54, and to a paper feeding switch 64 which is provided on the frame 1 in order to start loading the printer with the new cut sheet PS or PS'. Namely, the signals from the switches 54, 64 are received by the CPU 61. The paper feed motor 7 is connected to the CPU 61, via an output interface 66 and a motor driver 67 which are connected between the CPU 61 and the feed motor 7. The feed motor 7 is turned on and off according to drive or stop signals generated by the CPU 61.

The operation of the printer thus constructed will be described, referring to the flow chart of FIG. 11, which shows a program executed by the CPU 61 when the platen 2 is loaded with a new cut sheet PS or PS'. Initially, the CPU 61 executes step S1 to check if the paper feeding switch 64 is in the ON position, i.e., whether a paper feeding command to effect a paper loading operation is present or not. If the paper feeding switch 64 has been turned on, the CPU 61 goes to step S2 to check if the mode detecting switch 54 is in the ON position, i.e., if the printer is in the automatic paper feed mode, or not. If the printer is placed in the automatic paper feed mode, i.e., the changeover lever 42 is placed in its first position indicated in solid lines in FIGS. 6 and 8, with the detecting switch 54 in the ON position, the CPU 61 goes to step S3 wherein the paper feed motor 7 is operated in the reverse direction. Then, the CPU 61 executes step S4 to check if the feed motor 7 has been operated to step the predetermined number of steps which is stored in the RAM 63. Steps S3 and S4 are repeatedly executed until the predetermined number of steps has been reached.

The operation of the feed motor 7 in its reverse direction causes the platen 2 to be rotated in the clockwise direction P (opposite to the paper advancing direction Q) as indicated in FIGS. 1 and 5, whereby the roller shaft 22 is rotated in the direction indicated by arrow in FIGS. 5 and 6, via the transmission mechanism 31 which is not disconnected by the cut-off mechanism 49. As a result, the feed rollers 23 on the roller shaft 22 are rotated in the counterclockwise direction (in FIG. 1). As the same time, the rotation of the pinions 45 at the opposite ends of the roller shaft 22 will cause the pair of rack members 47 to be moved upward, whereby the pair of pushing members 29 are advanced in order to force the paper stack PS on the paper stacker 19 against the feed rollers 23. Thus, the top of the paper stack PS is pressed in contact with the feed rollers 23 by the pushing members 29. Consequently, the top sheet PS of the paper stack in the stacker 19 is fed by the feed rollers 23, along the first paper path 55, toward the paper advancing rollers 15, 16. Since the advancing rollers 15, 16 are now rotated in the directions indicated by arrow in FIG. 1, i.e., in the counter paper-advancing direction, the leading end of the cut sheet PS will not pass the nip of the advancing roller 15, 16. In other words, the cut sheet PS is stopped with its leading edge held in abutting contact with the nip of the advancing rollers 15, 16.

While the contact pressure between the paper stack PS and the feed rollers 23 is increased as the pushing members 29 are advanced toward the feed rollers 23, it is noted that when the contact pressure exceeds a predetermined upper limit, the spring clutch 46 shown in FIGS. 2 and 7 is disengaged to disconnect the right-hand side rotor 44 from the rotating gear 38, and thereby stop the advancing movement of the pushing members 29. Thus, the contact pressure between the paper stack PS and the feed rollers 23 can be maintained at a suitable level, irrespective of the number of the cut sheets PS of the paper stack on the paper stacker 19. This assures reliable feeding actions of the feed rollers 23 to feed the top sheet PS from the paper stacker 19.

The number of stepping pulses to operate the feed motor 7 in the reverse direction is determined so that the leading end portion of the cut sheet PS fed by the feed rollers is buckled by a suitable amount with the leading edge stopped by the advancing rollers 15, 16, as depicted in two-dot chain line in FIG. 1. In this buckled state, the leading portion of the cut sheet PS is held in contact with the guide plate 21 which serves as an earth member for discharging the static electricity of the cut sheet PS or PS'. After the feed motor 7 has been operated to step the predetermined steps, that is, when the answer to the checking in step S4 becomes affirmative (YES), the CPU 61 then goes to step S5 in which the feed motor 7 is operated in the forward paper advancing direction. Step S5 is followed by step S6 wherein the CPU 61 checks if the feed motor 7 has been operated by the predetermined number of steps stored in the RAM 63. Steps S5 and S6 are repeated until the predetermined number of steps is reached.

The operation of the feed motor 7 in the forward direction will cause the platen 2 to be rotated in the paper advancing direction Q as indicated in FIGS. 1 and 5, whereby the driving advancing rollers 15 are positively rotated in the counterclockwise direction (in FIG. 1) via the transmission mechanism 31. Accordingly, the cut sheet PS is allowed to pass through the nip of the advancing rollers 15, 16, and advanced by these rollers toward the platen 2. In the meantime, the roller shaft 22 is rotated in the clockwise direction (in FIG. 1) via the transmission mechanism 31, and the spring clutch 46 between the gear 38 and the right-hand side rotor 44. The rotation of the pinions 45 with the roller shaft 22 will allow the rack members 47 to be moved in the downward direction, thereby permitting the pushing members 29 to be moved away from the feed rollers 23. Thus, the paper stack PS is held spaced from the feed rollers 23 while the previously fed cut sheet PS is advanced by the advancing rollers 15, 16. In this connection, it is noted that while the spring clutch 46 does not act to positively transmit the clockwise rotation of the gear 38 (if seen in FIG. 1) to the rotor 44, the frictional force of the spring clutch 46 against the gear 38 and the rotor 44 is sufficient to rotate the roller shaft 22, i.e., to rotate the pinions 45 engaging the rack members 47, since substantially no load is exerted on the roller shaft 22, and since the paper stack PS, rack members 47, pushing members 29, and other related members tend to be moved by gravity to their lower position. Further, although the feed rollers 23 on the roller shaft 22 are rotated in the clockwise direction, this rotation of the rollers 23 will have a significant effect on the top sheet PS on the paper stack, since the movement of the paper stack PS away from the feed rollers 23 is started at the same time when the rotation of the rollers 23 is started.

The number of stepping pulses to operate the feed motor 7 in the forward direction is determined so that the cut sheet PS is advanced round the platen 2, as indicated in dashed line in FIG. 1, until the first line to be printed on the sheet PS is located between the platen 2 and the print head 6. That is, the feed motor 7 is turned off when the cut sheet PS is advanced to the desired printing start position. Since the leading edge of the cut sheet PS fed from the paper stacker 19 is determined by the paper advancing rollers 15, 16, the stepping operation of the feed motor 7 by the predetermined steps permits the cut sheet PS to be advanced exactly to the predetermined printing start position. Thus, the paper loading operation in the automatic feed mode is completed, and the printer is set ready for printing on the cut sheet PS by the print head 6 with the carriage 5 being reciprocated along the platen 2, and with the platen 2 being rotated in the paper advancing direction Q to advance the cut sheet PS by a predetermined line-to-line distance at the end of printing of each line. As the printing proceeds, the printed leading portion of the cut sheet PS is ejected through the paper exit 13, by the rotation of the ejection rollers 11.

Figure 11:
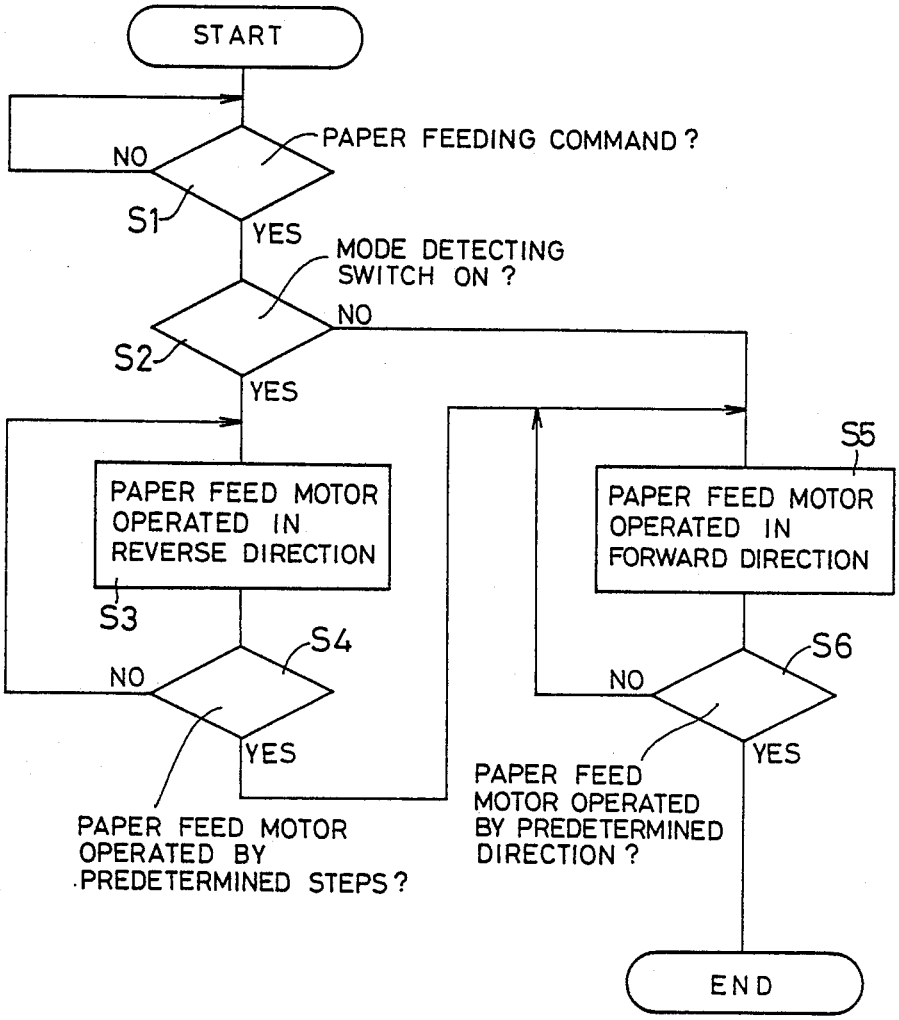
FIG. 11 is a flow chart illustrating a paper feeding operation.

Referring back to the flow chart of FIG. 11, if the checking in step S2 reveals that the mode detecting switch 54 is placed in the OFF position (the printer is placed in the manual paper feed mode) with the changeover lever 42 set in the second position indicated in two-dot chain line in FIGS. 6 and 8, the CPU 61 skips steps S3 and S4 to step S5. In this manual paper feed mode, the cut sheet PS' is manually inserted through the paper inlet 20, and is fed long the second paper path 56 indicated in one-dot chain line in FIG. 1, until the leading edge abuts on the nip of the advancing rollers 15, 16. Since the cut sheet PS' is guided by the guide plate 21, the static electricity of the sheet PS' is eliminated. Then, the paper feeding switch 64 is turned on, and the feed motor 7 is operated in the forward direction by the predetermined number of steps, in steps S5 and S6. Thus, the cut sheet PS' is advanced by the advancing rollers 15, 16, and is eventually fed round the platen 2 to the predetermined printing start position.

In the manual paper feed mode, the changeover lever 42 is placed in its second position, that is, the cut-off mechanism 49 is placed in its cut-off position in which the intermediate gear 43 on the lever 42 is separated from the gear 38 on the roller shaft 22. In this condition, the rotary motion of the feed motor 7 is not transmitted to the roller shaft 22, and the feed rollers 23 remain at rest while the pushing members 29 remain at their retracted position. If the cut-off mechanism 31 was not provided, or if the feed motor 7 was operatively connected to the roller shaft 22 even in the manual paper feed mode, an additional load to rotate the roller shaft 22 and advance the pushing members 29 would be exerted on the feed motor 7. In other words, the cut-off mechanism 49 including the changeover lever 42 frees the feed motor 7 from such an additional load while the cut sheet PS' is advanced in the manual paper feed mode.

It will be understood from the foregoing explanation that the CPU 61, and a portion of the ROM 62 which stores a program gram for executing steps S2-S6, constitute first motor control means for operating the feed motor 7 in the reverse direction by a predetermined amount to feed the cut sheet PS from the paper stacker 19 to the advancing rollers 15, 16, and for subsequently operating the feed motor 7 in the forward direction to advance the cut sheet PS from the advancing rollers 15, 16 toward the platen 2. It also will be understood that the CPU 61, and a portion of the ROM 62 which stores a program for executing steps S2, S5 and S6, constitute second motor control means for operating the fed motor 7 in the forward direction without initially operating the motor 7 in the reverse direction, in order to advance the manually inserted cut sheet PS' toward the platen 2.

In the illustrated embodiment, the pushing members 29 are moved away from the feed rollers 23 to prevent the cut sheet PS from being fed by the feed rollers 23 while the feed motor 7 is operated in the forward paper advancing direction in the automatic paper feed mode. However, it is possible to use a one-way clutch between the gear 38 and the feed rollers 23, so that the one-way clutch permits the feed rollers 23 to be rotated to feed the cut sheets PS from the stacker 19 only when the feed motor 7 is operated in the reverse direction, and so that the one-way clutch does not permit the feed rollers 23 to be rotated when the feed motor 7 is operated in the forward paper advancing direction. The use of such a one-way clutch is disclosed in Laid-Open Publication No. 58-6633 of Japanese Patent Application. In this case, too, the principle of the present invention may be practiced, provided the feed rollers 23 are operatively disconnected from the feed motor 7 when the manual paper insertion mode is selected.

While the present invention has been described in its preferred embodiment, it is to be understood that the invention is not limited thereto, and that various changes, modifications and improvements may be made in the invention, without departing from the spirit and scope of the invention defined in the appended claims.

What is claimed is:

1. A paper feeding device for feeding paper sheets to a printer having paper feeding means for feeding paper sheets to be printed on a print head while each paper sheet is supported on a platen, said paper feeding device comprising:

a bidirectionally operated paper feed motor operable in a forward direction to operate said paper feeding means in a paper feeding direction, and in a reverse direction opposite to said forward direction;

a paper stacker for storing a stack of the paper sheets;

a feed roller disposed for contact with a top of said stack of sheets, and rotated for feeding a top sheet of said stack from said paper stacker;

first passage means for defining a first paper path for directing said top sheet fed by said feed roller to said paper feeding means;

second passage means for defining a second paper path for directing another manually inserted sheet of paper to said paper feeding means with said manually inserted sheet passing said feed roller;

a transmission mechanism disposed between said feed roller and said paper feed motor, for transmitting a rotary motion of said paper feed motor to said feed roller such that said feed roller is rotated in a direction to feed said top sheet from said stacker when said feed motor is rotated in said reverse direction;

first motor control means connected to said feed motor, for operating said feed motor in said reverse direction by a predetermined amount to rotate said feed roller for feeding said top sheet from said stacker to said paper feeding means, and for subsequently operating said feed motor in said forward direction to operate said paper feeding means for advancing said top sheet to said print head;

second motor control means connected to said feed motor, for operating said feed motor in said forward direction without initially operating said feed motor in said reverse direction, to operate said paper feeding means for advancing said manually inserted sheet to said print head; and selector means for selectively rendering operative one of said first and second motor control means, to control said feed motor.

2. A paper feeding device according to claim 1, further comprising:

converting means including a pinion operatively connected to said paper feed motor, and a rack member engaging said pinion for converting bidirectional rotating movements of said pinion into linear reciprocating movements;

a pushing member disposed on one of opposite sides of said stack of sheets on said paper stacker, remote from said feed roller, said pushing member being moved by said linear reciprocating movements of said rack member, between an advanced position thereof for forcing said stack of sheets against said feed roller, and a retracted position thereof in which said stack of paper is spaced away from said feed roller; and a clutch disposed between said pinion and said paper feed motor, for disconnecting said pinion from said paper feed motor and thereby stopping an advancing movement of said pushing member when a contact pressure applied by said pushing member between said stack of sheets and said feed roller exceeds a predetermined upper limit.

3. A paper feeding device according to claim 1, wherein said selector means comprises a cut-off mechanism disposed in said transmission mechanism, and operated to a cut-off position in which transmission of said rotated motion of said feed motor to said feed roller is interrupted, and further comprises detecting means for sensing said cut-off position of said cut-off mechanism, said detecting means being connected to said first and second motor control means.

4. A paper feeding device according to claim 1, further comprising a pair of paper advancing rollers disposed in contact with each other at outer circumferential surface thereof, between said feed roller and said paper feeding means of the printer, said pair of paper advancing rollers being connected to said feed motor such that said paper advancing rollers are rotated in a paper advancing direction to advance said top sheet toward said paper feeding means when said feed motor is operated in said forward direction, and are rotated in a direction opposite to said paper advancing direction, so as to prevent a leading edge of said top sheet fed by said feed roller from passing through said paper advancing rollers toward said paper feeding means and thereby causing a leading portion of said top sheet to be buckled between said pair of paper advancing rollers and said feed roller.

5. A paper feeding device according to claim 1, further comprising:

pushing means operable between an advanced position thereof for forcing said stack of sheets against said feed roller, and a retracted position thereof in which said stack of sheets is spaced away from said feed roller; and converting means for converting said rotary motion of said feed motor into a movement of said pushing means between said advanced and retracted positions, said transmission mechanism and said converting means being operable to place said pushing means in said advanced position, when said feed motor is operated in said reverse direction, and to place said pushing means in said retracted position when said feed motor is operated in said forward direction.

6. A paper feeding device according to claim 3, wherein said transmission mechanism comprises a gear train including a first gear, a second gear and a third gear which are rotatable about a first axis, a second axis and a third axis, respectively, said cut-off mechanism comprising an operator-controlled lever which is supported pivotally about said first axis, said lever supporting said second gear for rotation about said second axis, and being pivotally movable between a first position for operative connection of said second gear with said third gear, and a second position for operative disconnection of said second gear from said third gear.

7. A paper feeding device for feeding paper sheets by paper feeding means comprising:

a paper stacker for storing a stack of the paper sheets;

a feed roller disposed opposite to said stack of sheets and operatively connected to a drive motor for rotation thereof by said drive motor for feeding the paper sheets of said stack from said paper stacker;

converting means including a pinion operatively connected to said drive motor, and a rack member engaging said pinion for converting a rotating movement of said pinion into a movement thereof;

a pushing member disposed on said paper stacker, remote from said feed roller, said pushing member being advanced by said movement of said rack member, for forcing said stack of sheets against said feed roller; and a clutch disposed between said pinion and said paper feed motor, for disconnecting said pinion from said paper feed motor when a contact pressure applied by said pushing member between said stack of sheets and said feed roller exceeds a predetermined upper limit, whereby the sheet of said stack pressed in contact with said feed roller by said pushing member is fed by rotation of said feed roller toward said paper feeding means, and an advancing movement of said pushing member toward said feed roller is stopped upon disconnection of said pinion from said drive motor by said clutch.

8. A paper feeding device according to claim 7, wherein said paper feeding means is also driven by said drive motor, said drive motor being operable in a forward direction to operate said paper feeding means in a paper feeding direction, and in a reverse direction opposite to said forward direction, said paper feeding device further comprising a transmission mechanism for transmitting a rotary motion of said drive motor to said feed roller such that said feed roller is rotated in a direction to feed said sheet in contact therewith from said paper stacker when said drive motor is rotated in said reverse direction, and such that said pinion is rotated in a direction to mvoe said rack member for forcing said stack of sheets against said feed roller when said drive motor is rotated in said reverse direction, and in an opposite direction to move said rack member for moving said stack of sheets away from said feed roller when said drive motor is operated in said forward direction.

9. A paper feeding device according to claim 7, wherein said feed roller is disposed opposite to a top of said stack of sheets on said paper stacker, while said pushing member is disposed on one of opposite sides of said stack which is remote from said feed roller, for pushing up said stack against said feed roller.

10. A paper feeding device according to claim 7, wherein said paper feeding means is also driven by said drive motor, said drive motor being operable to feed said paper to a printer which has a platen for supporting said paper, and a print head for printing on said paper while said paper is fed by said paper feeding means.

11. A paper feeding device for feeding paper sheets to a printer having paper feeding means driven by a paper feed motor for feeding paper sheets to be printed by a print head while each paper sheet is supported by a platen, said paper feeding device comprising:

a paper stacker for storing a stack of the paper sheets;

a feed roller disposed for contact with a top of said stack of sheets, and rotated for feeding a top sheet of said stack from said paper stacker first passage means for defining a first paper path for directing said top sheet fed by said feed roller to said paper feeding means;

second passage means for defining a second paper path for directing another sheet of paper to said paper feeding means without said another sheet passing said feed roller;

a transmission mechanism disposed between said feed roller and said paper feed motor, for transmitting a rotary motion of said paper feed motor to said feed roller, said transmission comprising a gear train including a first gear, a second gear and a third gear which are rotatable about a first axis, a second axis and a third axis, respectively; and a cut-off mechanism disposed in said transmission, and manually operated to a cut-off position in which transmission of said rotary motion of said feed motor to said feed roller is interrupted, said cut-off mechanism comprising an operator-controlled lever which is supported pivotally about said first axis, said lever supporting said second gear for rotation about said second axis, and being pivotally movable between a first position for operative connection of said second gear with said third gear, and a second position for operative disconnection of said second gear from said third gear, said cut-off mechanism further comprising biasing means for biasing said lever toward said first position, and lock means for locking said lever in said second position, against a biasing force of said biasing means, said lock means including a protrusion extending from said lever parallel to said first axis, and a stationary member disposed adjacent to said lever, said stationary member having an arcuate elongate hole formed along a circular arc which is described by said protrusion when said lever is pivotally moved about said first axis, said protrusion engaging said arcuate elongate hole with a slight clearance therebetween in a direction perpendicular to said circular arc, said stationary member including a locking portion which gives said arcuate elongate hole a constricted portion near one of opposite ends thereof which corresponds to said second position of said lever, said constricted portion having an original size slightly smaller than said protrusion in said direction, said locking portion being elastically deformed to expand said constricted portion, thereby permitting said protrusion to pass said constricted portion to said one end of said arcuate elongate hole when said protrusion is forced against said locking portion, said locking portion being restored to an original position to cause the expanded constricted portion to recover said original size, thereby locking said protrusion at said one end of said arcuate elongate hole, after said protrusion has passed the expanded constricted portion of said arcuate elongate hole.

12. A paper feeding device for feeding paper sheets to a printer having paper feeding means for feeding paper sheets to be printed by a print head while each paper sheet is supported by a platen, said paper feeding device comprising:

a paper feed motor operable in a forward direction to operate said paper feeding means in a paper feeding direction, and in a reverse direction opposite to said forward direction;

a paper stacker for storing a stack of the paper sheets;

a feed roller disposed for contact with a top of said stack of sheets, and rotated for feeding a top sheet of said stack from said paper stacker;

first passage means for defining a first paper path for directing said top sheet fed by said feed roller to said paper feeding means;

second passage means for defining a second paper path for directing another sheet of paper to said paper feeding means without said another sheet passing said feed roller;

a transmission mechanism disposed between said feed roller and said paper feed motor, for transmitting a rotary motion of said paper feed motor to said feed roller such that said feed roller is rotated in a direction to feed said top sheet from said stacker when said feed motor is rotated in said reverse direction;

a cut-off mechanism disposed in said transmission, and manually operated to a cut-off position in which transmission of said rotary motion of said feed motor to said feed roller is interrupted;

detecting means for sensing said cut-off position of said cut-off mechanism; and motor control means connected to said feed motor and said detecting means, for operating said feed motor in said reverse direction by a predetermined angular amount, and for subsequently operating said feed motor in said forward direction, when said cut-off position of said cut-off mechanism is not detected by said detecting means, said motor control means operating said feed motor in said forward direction without initially operating said feed motor in said reverse direction, when said cut-off position of said cut-off mechanism is detected by said detecting means.

13. A paper feeding device according to claim 12, wherein said transmission mechanism comprises a gear train including a first gear, a second gear and a third gear which are rotatable about a first axis, a second axis and a third axis, respectively, said cut-off mechanism comprising an operator-controlled lever which is supported pivotally about said first axis, said lever supporting said second gear for rotation about said second axis, and being pivotally movable between a first position for operative connection of said second gear with said third gear, and a second position for operative disconnection of said second gear from said third gear, said detector means being operable to detect at least one of said connected and disconnected positions of said operator-controlled lever.

14. A paper feeding device accoring to claim 12, further comprising a pair of paper advancing rollers disposed in contact with each other at outer circumferential surfaces thereof, between said feed roller and said paper feeding means of said printer, said pair of paper advancing rollers being connected to said feed motor such that said advancing rollers are rotated in a paper advancing direction to advance said top sheet toward said paper feeding means when said feed motor is operated in said forward direction, and are rotated in an opposite direction opposite to said paper advancing direction, so as to prevent a leading edge of said top sheet fed by said feed roller, from passing therethrough toward said paper feeding means, thereby causing a leading portion of said top sheet to be buckled between said pair of paper advancing rollers and said feed roller.

15. A paper feeding device according to claim 14, wherein said second paper path leads to said pair of paper advancing rollers.

16. A paper feeding device according to claim 14, further comprising an electrically conductive member which is connected to the ground and disposed such that said buckled leading portion of said top sheet contacts said electrically conductive member.

17. A paper feeding device according to claim 16, wherein said electrically conductive member consists of a generally planar partition wall member which constitute parts of said first and second passage means, and which separates said first and second paper paths from each other, said partition wall member being disposed so that not only said top sheet, but also said another sheet fed along said second paper path can contact said partition wall member.

18. A paper feeding device for a printer, comprising:

a paper stacker for storing a stack of paper sheets;

a feed roller disposed for contact with a top of said stack of sheets and rotatable for feeding a top sheet of said stack from said paper stacker;

a pair of paper advancing rollers disposed in contact with each other at outer circumferential surfaces thereof, between said feed roller and said printer, in a paper path from said paper stacker to said printer;

drive means for rotating said feed roller to feed said top sheet from said paper stacker toward said paper advancing rollers, while maintaining said paper advancing rollers in one of a first state in which said paper advancing rollers are at rest, and a second state in which said paper advancing rollers are rotated in a reverse direction opposite to a forward direction that causes said top sheet to be advanced toward a printing position of said printer;

said paper advancing rollers placed in said one of said first and second states causing a leading portion of said top sheet fed by said feed roller from said paper stacker to be buckled with a leading edge of said top sheet in abutting contact with a nip of said paper advancing rollers, before said top sheet is advanced to said printing position by rotating movements of said paper advancing rollers in said forward direction; and an electrically conductive member which is connected to a ground and which is disposed in a portion of said paper path between said feed roller and said paper advancing rollers, such that said buckled leading portion of said top sheet contacts said electrically conductive member before said top sheet is advanced by said paper advancing rollers.

19. A paper feeding device according to claim 18, wherein said electrically conductive member consists of a paper guide plate which defines a part of said portion of said paper path, on one side of said top sheet to which said leading portion thereof is buckled.

20. A paper feeding device for a printer, comprising:

a paper stacker for storing a stack of paper sheets;

a feed roller disposed for contact with a top of said stack of sheets and rotatable for feeding a top sheet of said stack from said paper stacker;

drive means for rotating said feed roller;

first passage means for defining a first paper path for directing said top sheet fed by said feed roller to said printer;

second passage means for defining a second paper path which has a paper inlet through which another sheet of paper is manually inserted into said printer, without said another sheet passing from said feed roller; and an electrically conductive partition wall which is connected to a ground and which is disposed between said first and second paper paths, so as to separate said first and second paper paths from each other, said first and second passage means guiding said top sheet and said another sheet along said first and second paper paths such that said top sheet and said another sheet contact said partition wall.

* * * * *